US007918095B2

(12) United States Patent
Munson

(10) Patent No.: US 7,918,095 B2
(45) Date of Patent: Apr. 5, 2011

(54) HEAT ACTUATED COOLING SYSTEM

(75) Inventor: David Murray Munson, Dallas, TX (US)

(73) Assignee: FOI Group, LLC, Dallas, TX (US)

( * ) Notice: Subject to any disclaimer, the term of this patent is extended or adjusted under 35 U.S.C. 154(b) by 424 days.

(21) Appl. No.: 12/157,680

(22) Filed: Jun. 12, 2008

(65) Prior Publication Data

US 2008/0307804 A1 Dec. 18, 2008

Related U.S. Application Data

(60) Provisional application No. 60/934,205, filed on Jun. 12, 2007.

(51) Int. Cl.
*F25B 15/00* (2006.01)

(52) U.S. Cl. ..... 62/101; 62/486

(58) Field of Classification Search ..... 62/101, 62/112, 475, 476, 486, 529; 165/63, 64, 165/65

See application file for complete search history.

(56) References Cited

U.S. PATENT DOCUMENTS 3,593,540 A * 7/1971 Hopkins ..... 62/476
3,661,200 A * 5/1972 McNamara ..... 165/42
3,922,873 A * 12/1975 Leonard ..... 62/84
3,977,204 A * 8/1976 Bourne ..... 62/85
3,985,529 A * 10/1976 Petersson ..... 62/633
3,990,264 A * 11/1976 Patnode et al. ..... 62/476
4,003,215 A * 1/1977 Roach ..... 62/476
4,018,694 A * 4/1977 Anderson ..... 252/69
4,094,355 A * 6/1978 Blytas ..... 62/101
4,102,388 A * 7/1978 Blytas ..... 62/101
4,138,850 A * 2/1979 Tchernev ..... 60/641.14
4,151,721 A * 5/1979 Kumm ..... 62/79
RE30,252 E * 4/1980 Leonard ..... 62/84
4,205,531 A * 6/1980 Brunberg et al. ..... 62/101
4,470,272 A * 9/1984 Itoh et al. ..... 62/474
4,623,018 A * 11/1986 Takeshita et al. ..... 165/104.12
4,993,239 A * 2/1991 Steidl et al. ..... 62/480
5,057,132 A * 10/1991 Lebrun et al. ..... 62/4
5,237,827 A * 8/1993 Tchernev ..... 62/106
5,636,526 A * 6/1997 Plzak et al. ..... 62/475
5,964,097 A * 10/1999 Goetz et al. ..... 62/101

OTHER PUBLICATIONS

"Crosley IcyBall" website: http://crosleyautoclub.com/IcyBall/crosley_icyball.html.
Michael A. Banks, "The Icyball David Forbes Keith's Too-Brilliant Invention" Canadian Consulting Engineer, Dec. 2006.

* cited by examiner

*Primary Examiner* — Mohammad M Ali
(74) *Attorney, Agent, or Firm* — D. Scott Hemingway; Hemingway & Hansen, LLP

(57) ABSTRACT

The system uses a batch method process absorption cooling through a number of separate sealed two compartment containers which are moved physically between a heating area, a cooling area, a storage area and a refrigeration area. Pressure differentials alone between the two sections of a vessel power refrigerant movement and evaporation of refrigerant. A valve separates a refrigerant collector and evaporator section from an absorber/desorber section allowing the absorbent and refrigerant to be kept separate until needed. This system can be used with either ammonia water mixtures or with lithium bromide water mixtures.

20 Claims, 5 Drawing Sheets

HEAT ACTUATED COOLING SYSTEM

RELATED APPLICATION DATA

This application is related to Provisional Patent Application Ser. No. 60/934,205 filed on Jun. 12, 2007, and priority is claimed for this earlier filing under 35 U.S.C. §119(e). The Provisional patent application is also incorporated by reference into this utility patent application.

TECHNICAL FIELD OF THE INVENTION

An apparatus and method of refrigeration based on absorption cooling.

BACKGROUND OF THE INVENTION

Absorption cooling cycles offer great potential to utilize waste or low-grade heat but have been hampered by low efficiency, high cost, and space requirements compared to compression-based refrigeration. Current commercial absorption refrigeration devices have a limited market demand due to high cost and low efficiency.

As concerns about global warming continue to grow, technologies to reduce energy requirements have received greater attention.

An absorption refrigerator is similar to a regular compressor refrigerator in that the cooling takes place by evaporating a liquid with a very low boiling point. When the liquid evaporates or boils, it removes heat with it, and it will continue to do so either until the liquid is all boiled, or until everything has become so cold that the boiling point has been reached. The only significant difference between absorption and compressor refrigerators is how the refrigerant gas is converted back into a liquid for reuse.

A compressor refrigerator uses a compressor to increase pressure on the gas, causing it to convert back to liquid again after cooling. An absorption refrigerator uses two components which have a strong affinity to combine, to absorb the refrigerant gas into to the absorbing liquid. This process can require no moving parts and be powered only by heat.

Absorption refrigeration cycle was the first widely used refrigeration system. In the days before rural electrification, absorption refrigerators were widely used. These designs operated by using a high temperature gas burner to supply energy for movement of the working fluids using the percolation effect and then using the high-temperature exhaust to induce a draft for air movement. Today, many absorption refrigerators and cooling units still use combustion-supplied high-grade heat to provide the energy needed to drive the cooling process.

Fluorocarbon refrigerants and inexpensive sealed compressors made compression cycle refrigeration the predominant method after World War II. Nevertheless, absorption systems have continued to develop. Most of these modern absorption units are designed for static installations and are equipped with pumps, heat exchangers and cooling fans to improve efficiency. Progress has been incremental and unable to successfully compete with compressor driven refrigeration except in niche markets.

One of the challenges faced is that both of the main refrigeration mixtures have significant problems. The classic ammonia-water system of the original concept provides low evaporator temperatures, but can cause serious injury and death if leaks occur and people come in contact with large amounts of gaseous ammonia. This danger encouraged development of systems using lithium bromide-water as the refrigeration fluid mixture. Lithium bromide also becomes a crystalline salt when the concentration of water gets to low, requiring care and controls to maintain liquid state. It uses water as the refrigerant requiring very low pressures in the evaporator and limiting the evaporator temperature to near 50 degrees F.

One of the greatest limitations on absorption refrigeration cycles is the difficulty of handling either high pressures in an ammonia cycle or the near vacuum of the lithium bromide cycle. Pumps and heat exchanger have incorporated design improvements. Many existing systems are not optimizing heat exchange, especially when high ambient temperatures cause low temperature differentials, causing efficiency to drop.

A low heat exchange temperature differential requires significant dwell time to transfer maximum heat energy, but most refrigeration units operate on fixed mass flow rate designs. To maintain the required pressure differential between the desorber and absorber requires pumps and throttling valves in commercial systems, both of which reduce efficiency. There is a need for an improved system that offers a solution to the above-identified issues.

SUMMARY OF THE INVENTION

The system uses a batch method process absorption cooling through a number of separate sealed two compartment containers which are moved physically between a heating area, a cooling area, a storage area and a refrigeration area. The mechanical method of moving the vessels can range from electrically powered handling systems to thermally powered devices to human powered methods in third world countries. Pressure differentials alone between the two sections of a vessel power refrigerant movement and evaporation of refrigerant. A valve separates a refrigerant collector and evaporator section from an absorber/desorber section allowing the absorbent and refrigerant to be kept separate until needed.

The Modular design allows substantial heat interchange between freshly desorped vessels and vessels awaiting desorption to increase efficiency and allows the use lower temperature heat sources to vaporize refrigerant from the absorber/desorber section. Being independent from the other containers allows optimum time at each stage of the process, because of the ability to store vessels at any stage in the process. This system can be used with either ammonia water mixtures or with lithium bromide water mixtures.

DETAILED DESCRIPTION OF THE PREFERRED EMBODIMENTS

This invention uses a method of absorption cooling that will offer a significant improvement over the existing art by reducing or eliminating the need for externally supplied mechanical or electrical power, providing a higher coefficient of performance (COP), and additionally taking advantage of the lower nighttime air and radiant temperatures.

The absorption process can be very effective when using low-grade "waste" heat or solar energy to operate the desorber. While the overall COP will be below that of an efficient compressor refrigerator setup, the use of "free heat" offers an advantage. The ability to economically use solar energy or waste heat to provide refrigeration has been an elusive goal for engineers, despite the technology's long commercial history.

The invention is well suited to use heat from a variety of sources—solar, waste incineration, engine waste heat, geothermal, and other sources. It is intended to work well either as cogeneration or as a primary heat use.

This invention uses a number of sealed two-part process vessels which produce refrigeration using an absorption cooling method. These vessels consist of a compartment that holds the absorbent component, which is henceforth called the absorbing/desorbing section, a control valve section that keeps the refrigerant component separated from the absorbent until refrigeration is desired, and a refrigerant compartment.

These vessels are moved from a storage area to a heating area where all of the refrigerant component is boiled out of the combined mixture in the absorbing/desorbing section. During and after heating the refrigerant vapor travels thru the control valve into the unheated refrigerant section of the vessel. There the refrigerant condenses on the wall of the lower temperature refrigeration section (e.g. the refrigerant collector and evaporator section).

At the end of heating (or desorbing), the valve is closed and the vessel is then moved to a heat exchange area, where the vessel can cool, while warming used vessels awaiting desorption. After cooling below the needed temperature for effective heat exchange, the separated refrigerant is further cooled by the best available method. The vessel can be cooled by geothermal cooling, nighttime air or radiant cooling to increase cooling efficiency.

The four figures shown each represent a phase of the absorption cycle as used in this invention. These phases are storage or holding before desorption, desorption, storage or heat exchange after desorption and release of refrigerant for refrigeration with reabsorption.

Figure 1:
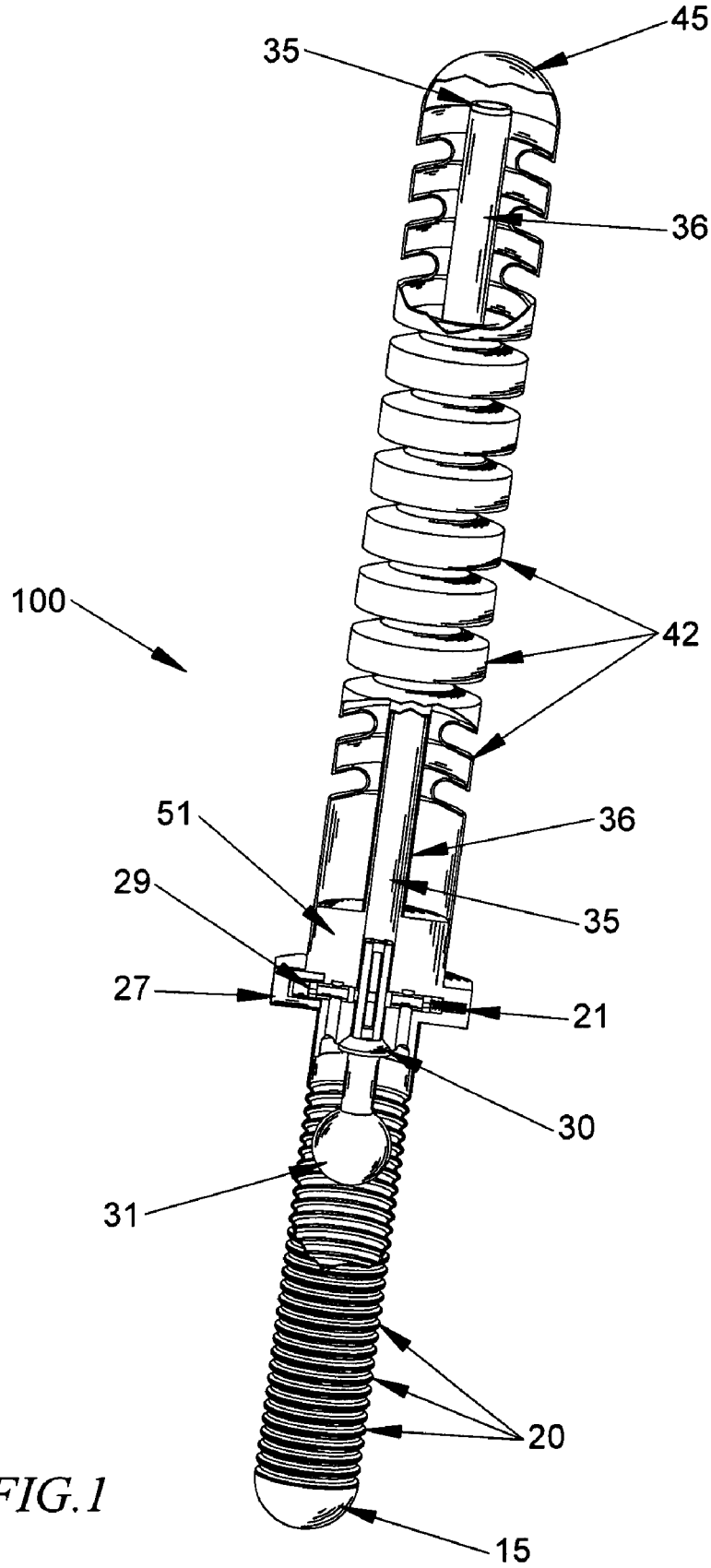
FIG. 1 is a cutaway prospective view showing one embodiment of the invention.

FIG. 1 shows the three described sections of vessel 100 used in the invention with the refrigerant absorbed into the absorbent. The vessel 100 primarily consists of two cylindrical sections and a central control valve section. The first section 15 is the refrigerant collection, condensation and evaporator compartment and has only very low pressure refrigerant vapor inside at the phase shown in FIG. 1.

At the other end, the second absorber/desorber section 45 is filled with the absorbent-refrigerant mixture. Section 45 has a central tube 35 running from the central section to near the upper end of section 45 which allows refrigerant vapor to move between Section 45 and Section 51. Surrounding the transfer tube is an insulating sleeve 36 that keeps the refrigerant fluid/absorbent mixture near the outer wall of section 45 and minimizes heat transfer from the mixture to refrigerant vapor traveling down tube 35 to the refrigerant section 15 during the later desorption phase. The two sections are mated to a thermal isolating section 51 that also houses the control spool valve 29 and has a poppet type valve 30 which closes the main tube 35 after desorption and remains closed until refrigeration is needed.

In FIG. 1 the vessel is awaiting desorption and condensation and separation of the refrigerant from the absorbent. Because the absorbent has absorbed the refrigerant, it is not necessary for the main isolated valve 30 to be closed. This valve 30 is operated by rising refrigerant level at the end of desorbtion. It is equipped with a float 31 which causes the valve to rise until it shuts as the condensed refrigerant fills the section 15. Spool valve 29 is spring 21 loaded to remain closed except when needed to initiate refrigeration.

There is also an attachment rim 27 both to position the vessel 100 on a heat exchange rack, storage area or a parabolic mirror to provide heat in this embodiment. Section 45 is equipped with deep ribs 42 that both increase heat transfer during desorption and absorption, but also serve to catch the lithium bromide as it crystallizes when the solution becomes too concentrated and begins to precipitate. Section 15 has ribs 20 for increased heat transfer Section 45 and Section 15 are sized to allow all of the separated liquid refrigerant to be held by Section 15 and all of the combined mixture to be held by section 45 for greatest efficiency.

Figure 2:
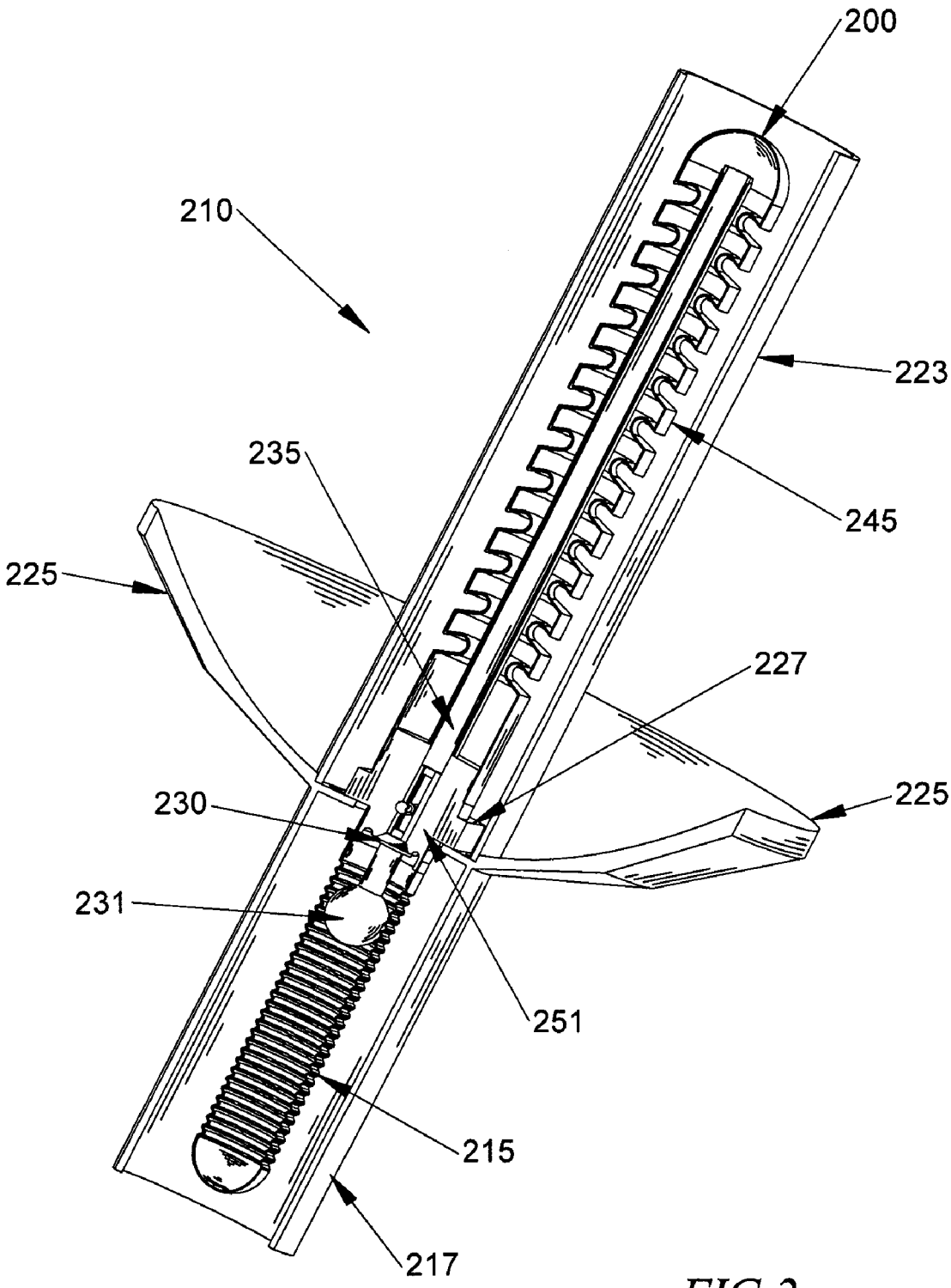
FIG. 2 is a sectional view of a solar heated vessel in the desorption stage.

FIG. 2 shows a solar heating arrangement 210 to desorb the refrigerant from the mixture. Vessel 200 is placed inside a convection insulating parabolic mirror 225. The mirror assembly is equipped with a clear tube 235 that serves as a wind shield, but not a radiant barrier so as to create an upward draft between sections. This draft prevents overheating of the surface of the section 245 and draws cool air upward through an opaque tube 217 located on the underside of the mirror which surrounds the condensing section 215.

This air cools in section 215 and then rises up at an elevated temperature around section 245. Attachment rim 227 locates vessel 200 so that section 245 is at the proper position for maximum solar heating. Parabolic mirror 225 can be designed with compound focal points to provide uniform heating of the section 245.

The refrigerant separation process involves heat addition to section 245 to evaporate/desorb the refrigerant and heat rejection from the refrigerant condensing section 215 simultaneously. The refrigerant vapor cools as it travels down tube 235 thru the valve section 251 and into the refrigeration condensation and collection section 215. The condensation of refrigerant in section 215 pulls the vapor into it. Unlike most absorption refrigeration systems, the separation of the phases of the absorption refrigeration process allows each phase to proceed at an optimum rate, pressure and temperature, independent of vessels at other phases of the cycle.

This desorption phase can proceed at a number of equilibrium points depending on ambient conditions. However within a given vessel the rate of evaporation/desorption will quickly equal the condensation rate. In a solar heated system this means that the rate will vary widely as the solar flux and ambient temperature change.

With parabolic reflector 225 of an area of 1 square meter, and 1 kilogram of water as refrigerant dissolved in several Kilograms of Lithium Bromide in section 245, desorbing times will vary from less than one half hour to perhaps more than an hour, due to solar flux variation. This slow desorption allows a low temperature differential between ambient temperature and section 215 for more effective condensation. It likewise allows lower cost, less thermally conductive and lower operating temperature materials to be used.

After all of the desired refrigerant has condensed in the section 215 the liquid refrigerant lift the valve float 231 and attached valve 230 moves into the closed position. The sealed vessels 200 possess an amount of refrigerant that is matched to the volume of the section 215 to ensure virtually all of the evaporated refrigerant condenses in section 215 as the valve 230 closes. Due to the design of valve 230, vapor pressure buildup on the side of desorbing section 245 can push open valve 230 to allow more vapor to condense in section 215, however the angled seat design of valve 230 serves as a check valve preventing any condensed refrigerant or vapor from traveling back to section 245 before the spool valve 230 is opened.

After desorption is finished, the vessel 200 is removed from the solar heating arrangement 210. A variety of heat sources and methods could and are likely to be substituted for the direct solar heating method disclosed as a preferred embodiment either as a substitute or supplement to this method. This heating could include any combination of common conduction, convection and radiant heat sources. These sources could also include waste heat from industrial or residential sources. One of the strengths of this invention is its flexibility. Vessels can be heated by different heat sources even as environmental conditions change momentarily, because the vessels are unaffected by the conditions of other vessels at other phases of the cycle.

Figure 3:
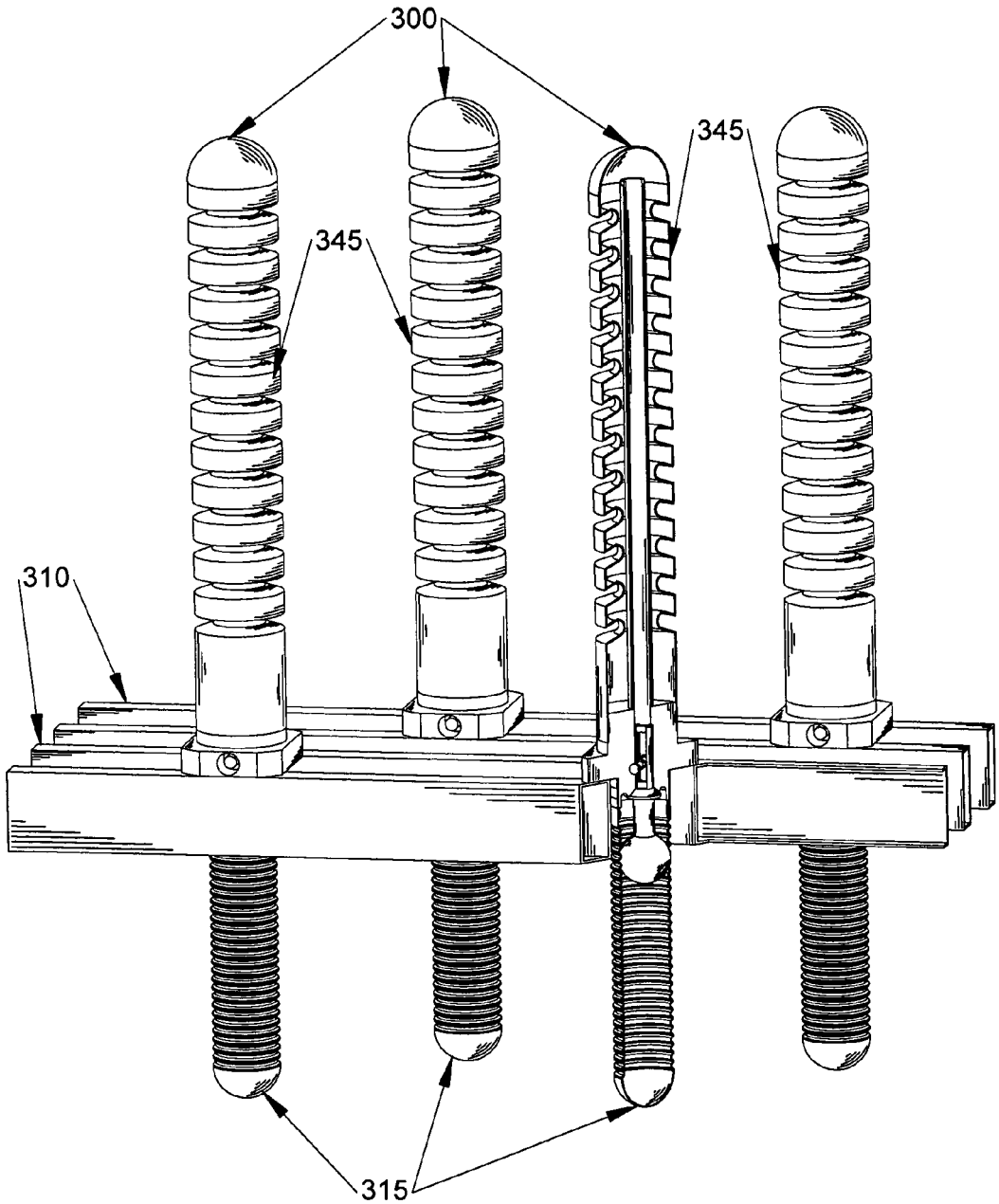
FIG. 3 is a view of a lithium bromide-water vessel cooling on a rack before refrigeration use; and, FIG. 4 is a schematic of a vessel evaporating refrigerant in a heat exchanger.

FIG. 3 shows a cooling and storage rack 310 in which vessel 300 is placed. After desorption the absorbent inside section 345 cools and reabsorbs any residual refrigerant vapor, lowering the pressure inside to near vacuum conditions. The refrigerant liquid inside section 315 also cools and further condenses refrigerant vapor inside section 315. Since section 315 is nearly full of liquid refrigerant and little or no absorbent is present, the pressure in section 315 is much higher than in section 345.

Although the vessel cooling begins as soon as heat is removed, preferably this cooling area offers both nighttime air-cooling and nighttime radiant cooling to substantially reduce the temperature of the vessel and refrigerant substantially below the daytime temperature. In some regions radiant nighttime cooling effective temperatures and heat flow is significant. Vessels may be larger to use this resource. Vessel cooling can use air or heat exchange fluids depending on application.

Figure 4:
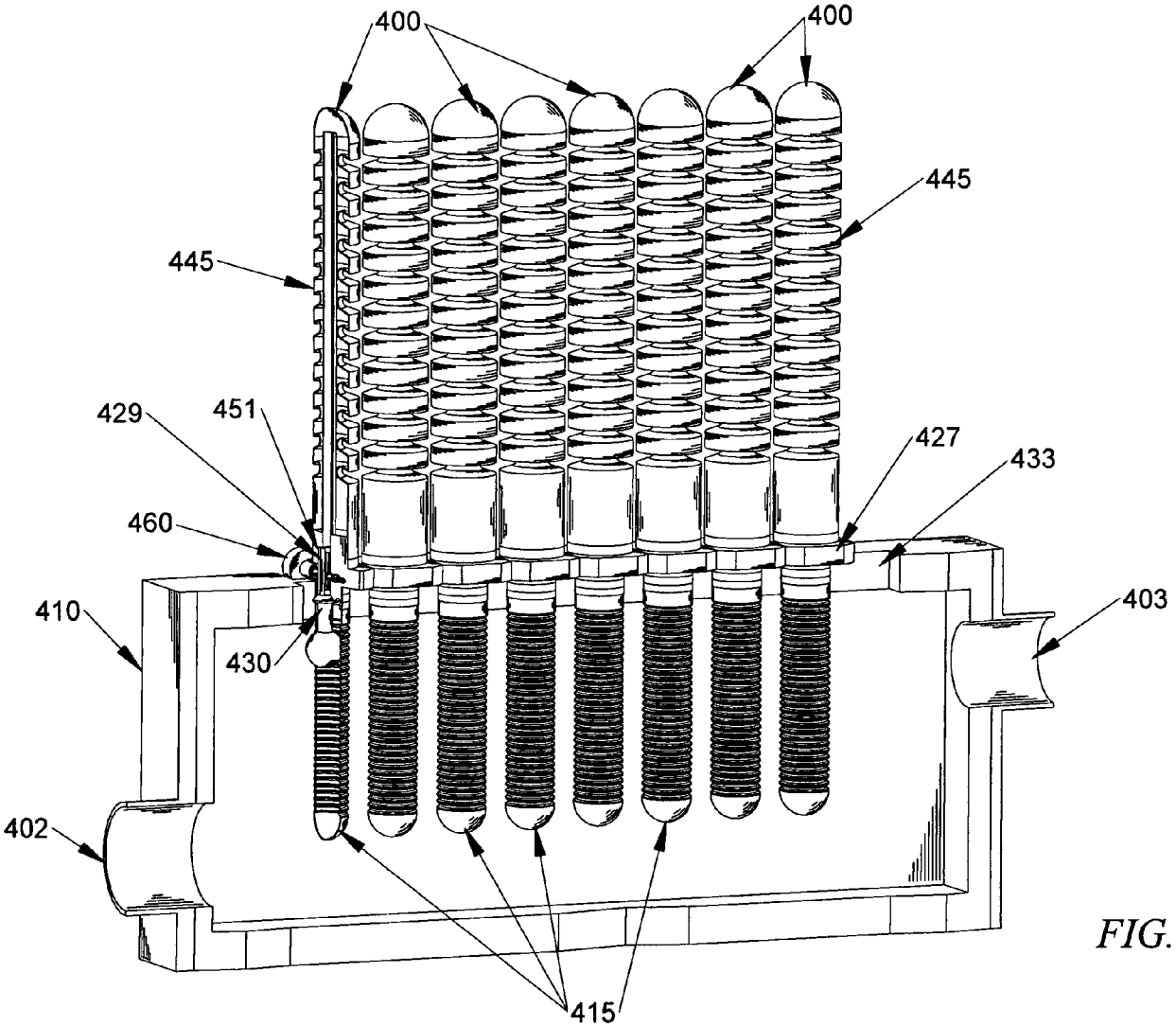

FIG. 4 shows a multiple vessel low temperature heat exchanger 410. There one or more of the vessel 400 are held. It is supported and insulated by attachment ring 427. When refrigeration is needed the magnetically operated pressure balanced spool valve 429 opens. This spool valve 429 located in section 451 is opened by placing a magnet 460 into the cavity 461 around the spool valve passageway causing the spool 429 to move towards the magnetic device 460 and opening the valve land.

The spool valve 29 releases refrigerant vapor to equalize pressure between the two chambers which allows the refrigerant to evaporate in the refrigerant holding section 415. After a predetermined period of time, the refrigerant liquid level will drop sufficiently for the larger valve 430 to open allowing a higher evaporation rate due to the lower pressure drop across the valve 430. Once the valve 430 has opened, the magnetic device 460 is retracted allowing the spool valve 429 to close.

The released refrigerant vapor will be reabsorbed by the absorbent in 445. This absorption maintains the low pressure needed for the refrigerant in the refrigerant section, to evaporate at the desired low temperature needed to remove heat from the refrigerant side of the vessel 415 within the cold heat exchanger 410. Eventually all of the refrigerant has evaporated from section 415 and is reabsorbed in section 445, and the vessel is ready to be returned to the heating area for desorption.

The cold heat exchanger 410 is equipped with one or more slots 433 that allow the vessels 400 to be inserted into the slot at one end where the valve 429 can be opened and moved slowly along the slot until at the end, the vessel 400 with all of its refrigerant evaporated is removed. Thus each time a vessel 400 is removed, the line of vessels shifts and a new cooled desorbed vessel 400 is inserted ready to be activated.

The absorbent side 445 of the vessel 400 is heated by the absorption process. This section 445 of the vessel 400 will generate heat from the refrigerant condensation. Some of this heat can be used to preheat the section 445 for the next desorbing phase or used for other uses. Traditional absorption pumped systems use heat exchangers to remove this heat and maintain an even absorber temperature.

With these separate vessels, the temperature can be allowed to rise as the absorbent in section 445 absorbs more refrigerant. Retaining the heat given off during absorption would reduce the heat required to desorb during step 1. This design is designed to function outside of the design capabilities of current technology and reuse of this currently wasted heat will increase efficiency. In a counter flow type heat exchanger such as this, a vessel 400 is exposed to higher temperatures as it moves towards the heat exchangers inlet 402 which receives a heated solution or heated gas that is passes through to outlet 403. This higher temperature allows the refrigerant to evaporate at rising temperatures as it is moved because the vessels 400 are independent of each other. This independence will allow the absorber to rise in temperature and pressure more while all the refrigeration evaporates more quickly.

Figure 4A:
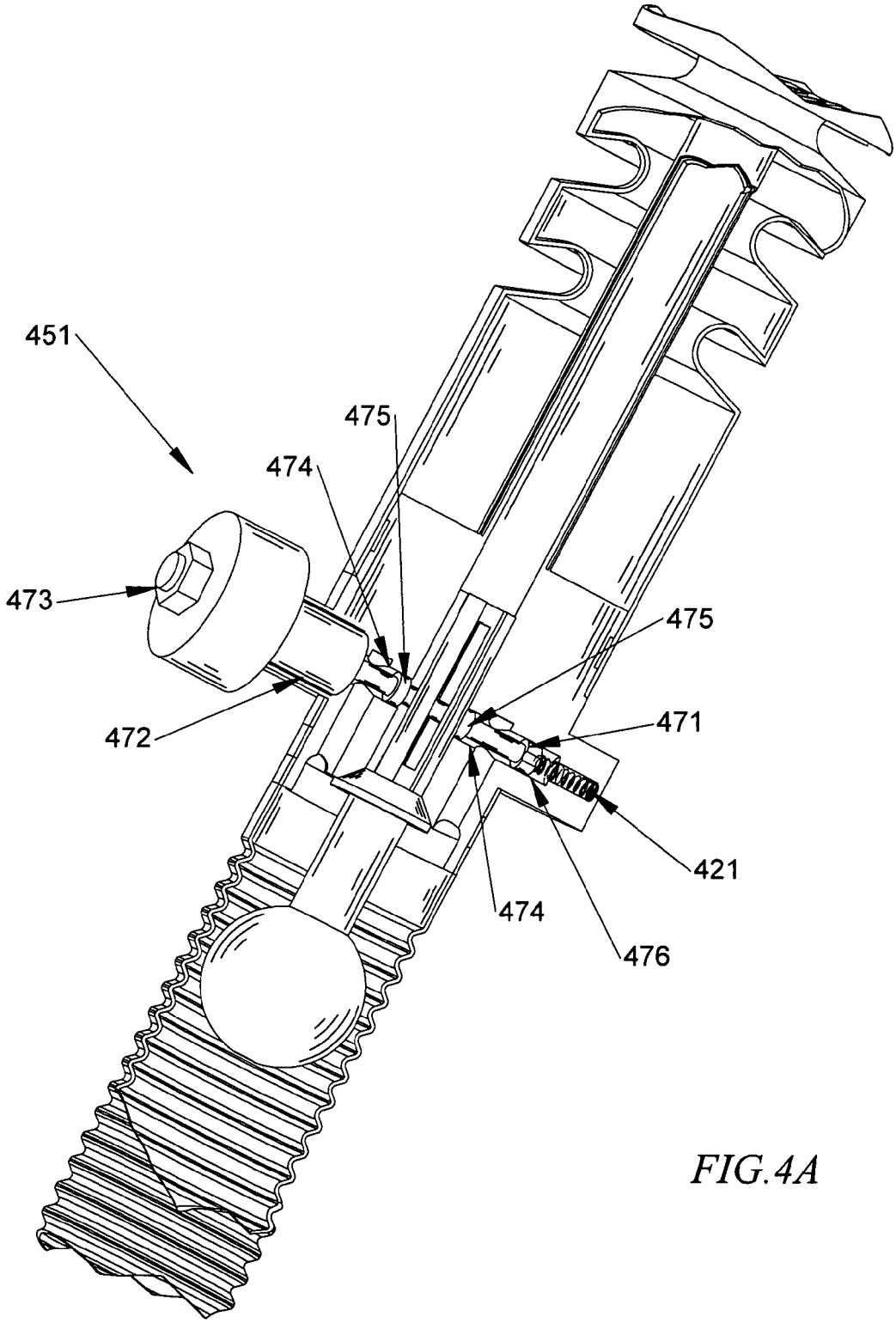

FIG. 4*a* shows a close up of control valve section 451 showing the spool control valve 471 opened. Spool vave 471 has been opened by magnetic valve actuator 473 which has been inserted into the spool valve passageway 472. The force applied by the actuator overcomes the force from the spring 421 and moves the spool 471 away from the magnetic valve actuator 471. This movement creates an opening between the end of the spool valve sealing surface 474 and the land 475 of the bore 476 which the spool valve 471 operates in.

As was shown by these figures, any number of vessels, or units, are used. Each unit is operated in a sequential intermittent cycle. Because each unit is sealed and unaffected by the number of units, capacity and ability to function efficiently in very hot climates can be raised by adding more units so that the units have either more cooling time or a shorter cycle time.

While thermal efficiency is highest using a 24-hour cycle time and utilize the favorable nighttime heat exchange conditions, the system can be operated on a much shorter cycle time. In a 125 degree F. daytime and a 90 degree F. or less nighttime air temperature, the system provides more cooling with a nighttime cool down.

Both flexibility and surge refrigeration capacity are present in this system. The main mechanical energy load is moving vessels thru the different phases. Mechanical energy needs are small, a small photovoltaic system can be used to provide needed power to move vessels, operate valves, and the control system.

The system can use either an ammonia-water or lithium bromide-water absorption mixture depending on the minimum temperature needed. Lithium bromide solution, because of its non-toxicity, lends itself to this system because of the precipitation of salts that occurs as more of the water refrigerant is removed, which in this system is an advantage. Current systems must leave a large amount of the water in the absorbent solution to prevent crystallization. This incurs extra thermodynamic work, needlessly heating and cooling unused water repeatedly.

In the invention, the desorber and absorber are the same, so precipitation is easily reversed and offers extra efficiency. After desorption, most of the water vapor goes to the water side (refrigerant section) of the vessel where it condenses. When the connecting valve closes, the pressure in the lithium bromide side (absorber/desorber section) falls due to reabsorption of the water vapor remaining in the absorption side by the lithium bromide salt crystals. Because the mass of the solid crystals is much lower than a typical concentrated lithium bromide bath after the typical partial desorption and the specific heat of the salt is likewise lower than the solution the lithium bromide cools much easier than a traditional solution.

In this system, the very low operating pressures reduce density of water vapor complicating component sizing. Due to the very different batch process used in this system, conventional examples are not entirely of use. In this continuous process, there is minimal dwell time and assumptions are made which may not be correct in a slow batch process. For example, solar heating by its nature is a unsteady heat source. Solar flux rises and falls as the day progresses and is vulnerable to clouds. The modular nature of this system corrects for the variation in solar flux easily. The highest rate of desorption will be at times when air conditioning load is highest.

By keeping the desorbing compartment in the focal point of a solar collector and the refrigerant section shaded, the pressure will fluctuate until it reaches a point where refrigerant is condensed at the same rate as it desorbs. When the pressure begins to drop, that signifies that the refrigerant is condensing faster than it is desorbing. It is after this point that the desorbing process ends and the valve is closed. Note that at valve closing, the two compartments are at the same pressure so the valve requires little force.

The valve design is a poppet valve set to prevent refrigerant from flowing back to the absorber/desorber until refrigeration is needed. The absorber receives the vapor given off by the separated evaporator section. The absorber radiates heat, similar to a more traditional condenser. The lithium bromide may or may not be completely crystallized during desorption. Furthermore, after the valve is closed at the end of desorption and the whole vessel cools down, most of the water vapor in the desorbing section will be reabsorbed. This creates a strong vacuum in that chamber, which is needed to power the next evaporation and reabsorption cycle.

Numerous features can further increase efficiency by using heat exchanged between the vessels. In less than full day rotations, vessels leaving the cooling heat exchanger can be exchanged with vessels about to provide refrigeration. Long dwell times dramatically increases heat exchange efficiency without mechanical energy. A special conveying mechanism moves the vessels between a heating and cooling location, so that at the end of a movement cycle all the vessels are in direct contact with a vessel at the opposite point of the cycle. Thus, the coolest condensed vessel is in contact with the vessel which has just left the cooling heat exchanger, and so on, until the vessel just leaving the heating area is in contact with the vessel about to enter the heating area.

Ammonia-water is the choice for low temperature refrigeration. Because this system divides the refrigerant mixture into small separate amounts, it may make the use of ammonia as a refrigerant more feasible. Instead of all of the refrigeration being in a typical loop system, where a hole anywhere in the loop causes a complete release of the ammonia refrigerant, in this system, only the ammonia in a single vessel can leak out if a vessel develops a leak.

Because it is compartmentalized, a strong odor of ammonia will just be a signal to walk away for a moment and allow the faulty vessel to be discarded or recycled. The only moving part in contact with the mixture is the simple isolation valve, which can be piloted and magnetically activated while entirely enclosed in the outer casing of the vessel. Ammonia offers the opportunity to provide refrigeration and low freezing temperatures to a use.

Solar heating is also possible as an energy source with the invention either as a primary use or recovery of secondary waste heat and is preferred in many applications. While the exact design of the solar heat array is varied, one embodiment uses a series of one or more parabolic reflectors with central tracks designed to gradually heat vessels completely with minimal movement energy. These tracks can be capable of tracking the sun to maximize the solar gain and minimize array size. In the version depicted by FIG. 1, a simple parabolic collector is slipped over the vessel during heating and removed afterward. A variety of reflective materials may be used. Using heat discharges from higher temperature solar collection or waste heat from other thermal processes offers additional efficiency advantages.

The modular nature of the invention allows capture and use of intermittent heat sources such as incinerators, metal fabrication cooling fluids or braking loads. The ammonia cycle offers low enough temperatures to use ice storage to stockpile refrigeration for large occasional use venue like Churches, sports arenas and the like.

Night time and radiant cooling are conceptually very important. In desert regions, particularly those at high altitude, substantial cooling can be achieved on clear nights by using radiant cooling. This system can use this cooling as either a supplement or a replacement for much of the absorption cycle cooling. Additional radiant cooling specific vessels can be used as well.

One of the difficulties faced in radiant cooling efforts has been storing the refrigeration until it is needed. The Lithium Bromide cycle is well suited for nighttime radiant cooling, because it uses water as the refrigerant and in this system the precipitated lithium bromide is as small fraction of the total thermal capacity of the vessel. The ammonia-water system benefits from cooling the ammonia, but the absorbent water is cooled as well to no substantial advantage.

Ammonia evaporation temperature of −10 degrees farenheit means that significant specific heat must be removed from the ammonia even with nighttime cooling. Pre-cooling the refrigerant increases the effective cooling per vessel for both mixtures but benefits the lithium bromide most. Minimizing the effective temperature differential increases system efficiency.

The nighttime cooling utilizes the same equipment used during daytime solar energy collection, but because it increases capacity, it allows a smaller collector area to be used. Because radiant cooling is strongly affected by weather conditions, it cannot be relied upon as a sole source of refrigeration.

Because of the different fluid compositions in the two compartments, it is obvious that the pressure will also be different as they cool. The pressure on the absorber section will drop far below that of the side containing only refrigerant as the absorbent absorbs residual refrigerant vapor, creating a vacuum or pressure gradient and enabling the next stage of the process to function.

After being cooled, and when refrigeration is needed, the vessel is moved to a cold heat exchange area where the orifice valve between the two vessel sections is opened, allowing the refrigerant vapor to travel into contact with the absorbent. This causes a pressure drop in the refrigerant section, which causes additional refrigerant to evaporate and remove heat from the refrigerant side of the vessel within the cold heat exchanger. Eventually, most of the refrigerant is reabsorbed, and the vessel returned to the heating area for desorption. The absorbent side of the vessel is heated during the absorption process. This side of the vessel will emit heat to a heat sink and be preheated for the next desorbing phase.

The invention is durable and offers a greater cooling capacity thru the use of the sealed two-part vessel with only a simple valve as a moving part. A number of vessels, or units, are used. Each unit is operated in a sequential intermittent cycle. Because each unit is sealed and unaffected by the number of units, capacity and ability to function efficiently in very hot climates can be raised by adding more units so that the units have either more cooling time or a shorter cycle time. While thermal efficiency is highest using a 24-hour cycle time and utilize the favorable nighttime heat exchange conditions, the system can be operated on a much shorter cycle time. In a 125 degree F. daytime and a 90 degree F. or less nighttime environment, that the system provides more cooling with a nighttime cool down. Both flexibility and surge refrigeration capacity are present in this system. The main mechanical energy load is moving vessels thru the different phases. A small photovoltaic system can be used to provide needed power to move vessels, operate valves, and the control system.

The invention minimizes the mechanical energy required to operate an absorption cycle by eliminating pumps and fans as primary cycle components. It also allows long variable heat exchange times at minimal temperature differences. The system can utilize a variety of both heating and cooling sources, including geothermal heating and cooling, solar heating, engine waste heat, nighttime radiant cooling and lower nighttime air temperature to increase refrigeration capacity. The design also offers redundancy at almost every portion of the cycle giving high durability and availability. The modular nature of the system minimizes the possibility of a significant safety or environmental problem.

The prior art systems use pumps and fans to move working fluids and provide cooling air to enable a non stop refrigeration process. Pumping and fan loads are primarily met by electric powered pumps and fans. While these loads seem small for units operating on utility power, for a remote small generator-powered site, these loads must be multiplied 4 or 5 times making them very significant. The invention dispenses with these power loads and revolutionizes absorption cooling by using the batch method.

The system can use either an ammonia-water or lithium bromide-water absorption mixture depending on the minimum temperature needed. Ammonia has excellent thermodynamic qualities for refrigeration, and offers below freezing evaporation temperatures. However using Ammonia is complicated by its dangers. This system minimizes the risks by compartmentalizing the ammonia into many separate small quantities. In addition to safety risks, Ammonia and water have such a strong affinity that it is impossible to avoid some water vaporizing with the ammonia. Ammonia is used in commercial refrigeration using both the absorption cycle and predominantly the compression cycle. Ammonia leaks in large systems are dangerous and require evacuation. By using multiple separate cooling units there is little chance of a large leak. Because of the danger of leaks, every effort is made to minimize the amount of ammonia in an absorption system by moving the refrigerant rapidly thru the traditional systems requiring substantial pumping and cooling power. The invention is not constrained by such safety concerns, because the ammonia is subdivided into less hazardous quantities. It operates with minimal mechanical energy and greater thermal heat exchange efficiency.

Vaporization of some water vapor during the desorption part of the cycle in prior art systems results in condensed water diluting the condensed ammonia liquid and causes both efficiency and operational problems. These systems use a second stage of separation of increase the purity of the ammonia. This extra step increases energy use. The modular system has design features that remove the need for rectification and can operate with water carryover. Because of water carryover and vastly different operating pressure the vessel design is specific to the refrigerant absorbent combination.

Lithium Bromide

Lithium Bromide is a naturally occurring salt that has a very high affinity for water. Prior art machines air conditioners use water as the refrigerant and a water/lithium bromide solution as the absorpent. In order for water to evaporate at about 50 degrees a near total vacuum must be maintained in the evaporation zone. The relatively high boiling point limits this cycle to air conditioning and similar uses. It can not be used for refrigeration or freezing like the ammonia cycle. It is a safe mixture however the lithium bromide will precipitate out of the solution if its concentration gets too high.

Use of this invention allows full separation of water from the lithium bromide, increasing efficiency and increasing cooling capacity by weight and volume. The use of nighttime radiant or geothermal heat exchange allows the refrigeration water container to be cooled substantially, perhaps below the normal system evaporation temperature in certain favorable conditions. Separating almost all of the water from the lithium bromide increases the effectiveness of nighttime cooling. This type of system could be designed to operate on a once a day container rotation during light air conditioning loads in climates with good nighttime radiant cooling temperatures and good solar radiation. In times of peak loads the containers could be cycled more rapidly to meet peak needs. This would likely require motorized cooling methods to speed the container cycle time.

The use of geothermal cooling of the containers by lowering them into wellbores until the refrigerant end of the vessel is submerged in either ground water or a heat transfer closed water chamber would allow the vessels to be cooled down to near the refrigerant evaporation temperature.

In third world applications vessel cooling can be combined with water pumping to allow dual use of a wellbore or if the water is unusable strictly for cooling. Direct cooling of the vessels minimizes the fouling problems many direct water use systems have and increases the heat transfer temperature differential. For cooling only use the wellbore can be circulated by a floating piston that is pushed down inside a water filled tube from the water level of the well by the lowered vessel until the refrigerant end of the vessel is completely submerged. This action brings cooler water from below the pipe up between the outer and inner pipe and into the innermost area where the vessel has been lowered.

This circulation assures a low cooling temperature can be achieved. The vessel can be placed in a water lifting container that has a check valve in the bottom. When it is lowered down into the well water it fills and is lifted back to the surface. The lifted water is warmed by the vessel as it is returned to the surface. The process can be repeated until the vessel is fully cooled. Depending on the depth and availability of water either one large well bore or two small ones will allow offsetting containers to offset each others weight except for the water weight, minimizing power requirements. The lithium bromide containing section is under a severe vacuum after heating has ceased and can not leak out unless the container is penetrated and rendered useless.

Lithium bromide solution, because of its non-toxicity, may seem like the obvious choice and lends itself to this system because of the precipitation of salts that occurs as more of the water refrigerant is removed, which in this system is an advantage instead of a liability. However, leaving a large amount of the water in the absorbent solution to prevent crystallization incurs extra thermodynamic work, needlessly heating and cooling unevaporated water repeatedly.

In the invention, the desorber and absorber are the same, so precipitation is easily reversed and offers extra efficiency. After desorption, most of the water vapor goes to the water side (refrigerant section) of the vessel where it condenses. When the connecting valve closes, the pressure in the lithium bromide side (absorber/desorber section) falls due to reabsorption of the water vapor remaining in the absorption side by the lithium bromide salt crystals. Because the mass of the solid crystals is much lower than a typical concentrated lithium bromide bath after the typical partial desorption and the specific heat of the salt is likewise lower than the solution the lithium bromide cools much easier than a traditional solution.

In this system, the very low operating pressures reduce density of water vapor complicating component sizing. Due to the very different batch process used in this system, conventional examples are not entirely of use. In this continuous process, there is minimal dwell time and assumptions are made which may not be correct in a slow batch process. For example, solar heating by its nature is a unsteady heat source. Solar flux rises and falls as the day progresses and is vulnerable to clouds. The modular nature of this system corrects for the variation in solar flux easily. The highest rate of desorption will be at times when air conditioning load is highest. By keeping the desorbing compartment in the focal point of a solar collector and the refrigerant section shaded, the pressure will fluctuate until it reaches a point where refrigerant is condensed at the same rate as it desorbs. When the pressure begins to drop, that signifies that the refrigerant is condensing faster than it is desorbing. It is after this point that the desorbing process ends and the valve is closed. Note that at valve closing, the two compartments are at the same pressure so the valve requires little force.

The valve design resembles a poppet valve set to prevent refrigerant from flowing back to the absorber/desorber until refrigeration is needed. The absorber receives the vapor given off by the separated evaporator section. The absorber radiates heat, similar to a more traditional condenser. The lithium bromide may or may not be completely crystallized during desorption. Furthermore, after the valve is closed at the end of desorption and the whole vessel cools down, most of the water vapor in the desorbing section will be reabsorbed. This creates a strong vacuum in that chamber, which is needed to power the next evaporation and reabsorption cycle.

Numerous features can further increase efficiency by using heat exchanged between the vessels. In less than full day rotations, vessels leaving the cooling heat exchanger can heat exchange with vessels about to provide refrigeration. Long dwell times dramatically increases heat exchange efficiency without mechanical energy. A special conveying mechanism moves the vessels between a heating and cooling location, so that at the end of a movement cycle all the vessels are in direct contact with a vessel at the opposite point of the cycle. Thus, the coolest condensed vessel is in contact with the vessel which has just left the cooling heat exchanger, and so on, until the vessel just leaving the heating area is in contact with the vessel about to enter the heating area.

Obviously, ammonia-water is the choice for low temperature refrigeration Because this system divides the refrigerant mixture into small separate amounts, it may make the use of ammonia as a refrigerant more feasible. Instead of all of the refrigeration being in a typical loop system, where a hole anywhere in the loop causes a complete release of the ammonia refrigerant, in this system, only the ammonia in a single vessel can leak out if a vessel develops a leak. Because it is compartmentalized, a strong odor of ammonia will just be a signal to walk away for a moment and later the faulty vessel can be discarded or recycled. The only moving part in contact with the mixture is the simple isolation valve, which can be piloted and magnetically activated while entirely enclosed in the outer casing of the vessel. Ammonia offers the opportunity to provide refrigeration and low freezing temperatures to a use.

Solar heating is also possible as an energy source with the invention either as a primary use or recovery of secondary waste heat and is preferred in many applications. While the exact design of the solar heat array is varied, one embodiment uses a series of one or more parabolic reflectors with central tracks designed to gradually heat vessels completely with minimal movement energy. These tracks can be capable of tracking the sun to maximize the solar gain and minimize array size In the version depicted by FIG. 1, a simple parabolic collector is slipped over the vessel during heating and removed afterward. A variety of reflective materials may be used.

Using heat discharges from higher temperature solar collection or waste heat from other thermal processes offers additional efficiency advantages. The modular nature of the invention allows capture and use of intermittent heat sources such as incinerators, metal fabrication cooling fluids or braking loads. The ammonia cycle offers low enough temperatures to use ice storage to stockpile refrigeration for large occasional use venue like Churches, sports arenas and the like.

Night time and radiant cooling are conceptually very important. In desert regions, particularly those at high altitude, substantial cooling can be achieved on clear nights by using radiant cooling. This system can use this cooling as either a supplement or a replacement for much of the absorption cycle cooling. Additional radiant cooling specific vessels can be used as well. One of the difficulties faced in radiant cooling efforts has been storing the refrigeration until it is needed. The Lithium Bromide cycle is well suited for nighttime radiant cooling, because it uses water as the refrigerant and in this system the precipitated lithium bromide is as small fraction of the total thermal capacity of the vessel. The ammonia-water system benefits from cooling the ammonia, but the absorbent water is cooled as well to no substantial advantage. Ammonia evaporation temperature of −10 degrees Fahrenheit means that significant specific heat must be removed from the ammonia even with nighttime cooling. Pre-cooling the refrigerant increases the effective cooling per vessel for both mixtures but benefits the lithium bromide most. Minimizing the effective temperature differential increases system efficiency.

The nighttime cooling utilizes the same equipment used during daytime solar energy collection, but because it increases capacity, it allows a smaller collector area to be used. Because radiant cooling is strongly affected by weather conditions, it cannot be relied upon as a sole source of refrigeration.

While the invention has been particularly shown and described with respect to preferred embodiments, it will be readily understood that minor changes in the details of the invention may be made without departing from the spirit of the invention. Having described the invention, I claim:

The invention claimed is:

1. A system for cooling a predetermined area comprising:

a modular collector with an evaporator section separated from an absorber/desorber section by a valve; each modular collector having a refrigerant residing inside the enclosed space of the modular refrigerant collector for transfer between said evaporation section and said absorber/desorber section;

an absorbent located in the absorber/desorber section that absorbs a vapor from the refrigerant after the vapor comes into contact with the absorbent; and an attachment rim surrounding the modular collector to support the placement and movement of the modular collector;

a heating unit to position the modular collector on a rack where the modular collector is supported by an attachment rim, so the absorber/desorber section can be heated to release refrigerant vapor which allows the refrigerant vapor to travel to the evaporator section where the vapor is condensed and trapped in that section after the valve is closed;

a cooling unit to position the modular collector on a rack where the modular collector is supported by an attachment rim, so the collector refrigerates the area in the cooling unit upon opening the valve allowing the condensed refrigerant liquid to evaporate from its condensed state and travel to the low pressure area in the absorber/desorber section for future absorption by the absorbent.

2. The cooling system of claim 1 wherein the absorbent is a lithium bromide absorbent.

3. The cooling system of claim 1 wherein the refrigerant is an ammonia-based refrigerant.

4. The cooling system of claim 1 wherein the refrigerant is a water-based refrigerant.

5. The cooling system of claim 1 wherein modular collector is returned to heating unit to repeat the heating cycle.

6. The cooling system of claim 1 wherein the evaporator section possesses a larger volume ratio compared to the absorber/desorber section.

7. A system for cooling a predetermined area comprising:

a modular collector with an evaporator section separated from an absorber/desorber section by a valve; each modular collector having a refrigerant located in an enclosed space in the modular refrigerant collector and capable of being transferred between the evaporator section and the absorber/desorber section;

an absorbent located in the absorber/desorber section that absorbs a vapor from the refrigerant, when coming into contact with said absorbent;

an attachment rim surrounding the modular collector to support the placement and movement of the modular collector;

a heating unit to position the modular collector on a support rack where each modular collector is supported by an attachment rim so the absorber/desorber section can be heated to release refrigerant vapor which travels to the evaporator section, where the vapor is condensed and held after the valve is closed;

a cooling unit to position the modular collector on a support rack where each modular collector is supported by an attachment rim so the collector refrigerates the area in the cooling unit upon opening the valve and allowing the refrigerant to evaporate into its vaporized state, whereupon the vapor is absorbed by the absorbent.

8. The cooling system of claim 7 wherein the refrigerant can be located near exterior wall of insulating sleeve.

9. The cooling system of claim 7 wherein the refrigerant is a ammonia-water material.

10. The cooling system of claim 7 wherein the absorbent is a lithium bromide material.

11. The cooling system of claim 7 wherein the refrigerant is a water-based absorbent material.

12. The cooling system of claim 7 wherein evaporator section has larger volume compared to absorber/desorber section.

13. A method for cooling a predetermined area comprising:

providing a modular collector with an evaporator section separated from an absorber/desorber section by a valve, said collector contains a refrigerant that can be transitioned between the evaporator section and the absorber/desorber sections, and said absorber/desorber section having an absorbent that absorbs a vapor from the refrigerant after coming into contact with the absorbent and said collector having an attachment ring surrounding the modular collector to support placement and movement of the collector;

heating the collector in a heating unit on a support rack where each modular collector is supported by an attachment rim so the absorber/desorber section can be heated to release refrigerant vapor which travels to the evaporator section after the valve is opened and is condensed in the evaporator section and trapped in that area after the valve is closed;

refrigerating an area in a cooling unit by positioning the modular collector on a support rack where each modular collector is supported by an attachment rim in the cooling unit upon allowing the condensed refrigerant liquid to evaporate from its condensed state whereupon the refrigerant vapor travels to the absorber/desorber section after the valve is opened.

14. The cooling system of claim 13 wherein the absorbent is a lithium bromide absorbent.

15. The cooling system of claim 13 wherein the refrigerant is an ammonia-based refrigerant.

16. The cooling system of claim 13 wherein the refrigerant is a water-based refrigerant.

17. The cooling system of claim 13 wherein the modular collector is returned to heating unit to repeat the heating cycle.

18. The cooling system of claim 13 wherein the evaporator section possesses a larger volume ration compared to the absorber/desorber section.

19. The cooling system of claim 13 wherein the refrigerant can be located near exterior wall of insulating sleeve.

20. The cooling system of claim 13 wherein the modular collector has an insulating sleeve.

* * * * *